US011898446B1

(12) United States Patent
Dlugosz et al.

(10) Patent No.: US 11,898,446 B1
(45) **Date of Patent: *Feb. 13, 2024**

(54) TOOL RETAINER

(71) Applicant: Kennametal Inc., Latrobe, PA (US)

(72) Inventors: Arkadiusz Dlugosz, Zory (PL); James R. Geyer, Manns Choice, PA (US)

(73) Assignee: KENNAMETAL INC., Latrobe, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/816,193

(22) Filed: Jul. 29, 2022

(51) Int. Cl.
*E21C 35/197* (2006.01)

(52) U.S. Cl.
CPC ..... *E21C 35/197* (2013.01)

(58) Field of Classification Search
CPC ..... E21C 35/197
See application file for complete search history.

(56) References Cited

U.S. PATENT DOCUMENTS

| | | | | |
|---|---|---|---|---|
| 3,499,685 | A | 3/1970 | Kniff | |
| 3,512,838 | A | 5/1970 | Kniff | |
| 3,519,309 | A | 7/1970 | Engle et al. | |
| 3,767,266 | A | 10/1973 | Krekeler | |
| 4,327,947 | A | 5/1982 | Bower, Jr. | |
| 4,728,153 | A | 3/1988 | Ojanen et al. | |
| 4,850,649 | A | 7/1989 | Beach et al. | |
| 4,921,310 | A | 5/1990 | Hedlund et al. | |
| 5,503,463 | A * | 4/1996 | Ojanen | E21C 35/197 299/107 |
| 6,786,557 | B2 | 9/2004 | Montgomery, Jr. | |
| 7,922,257 | B2 | 4/2011 | Kammerer | |
| 2002/0074851 | A1 | 6/2002 | Montgomery | |
| 2002/0153175 | A1 | 10/2002 | Ojanen | |
| 2006/0125308 | A1 | 6/2006 | Sollami | |
| 2007/0024104 | A1 | 2/2007 | Monyak et al. | |
| 2007/0257545 | A1* | 11/2007 | Mouthaan | E21C 35/197 299/107 |
| 2009/0058173 | A1 | 3/2009 | Monyak et al. | |
| 2009/0160237 | A1 | 6/2009 | Kammerer | |
| 2009/0162159 | A1 | 6/2009 | Kammerer | |
| 2011/0006588 | A1 | 1/2011 | Monyak et al. | |
| 2012/0013168 | A1 | 1/2012 | Sollami | |
| 2015/0252670 | A1 | 9/2015 | Wachsmann et al. | |
| 2016/0273356 | A1 | 9/2016 | Ojanen | |
| 2020/0141094 | A1 | 5/2020 | Parzynski, Jr. et al. | |
| 2023/0084514 | A1 | 3/2023 | Dlugosz et al. | |

FOREIGN PATENT DOCUMENTS

| | | | |
|---|---|---|---|
| DE | 3712427 | A1 | 10/1988 |
| DE | 102008052389 | A1 | 4/2010 |
| DE | 102010017587 | A1 | 12/2011 |
| EP | 0264015 | A1 | 4/1988 |
| WO | WO2003004832 | A1 | 1/2003 |

OTHER PUBLICATIONS

International Search Report and Written Opinion for PCT/US23/61465 filed Jan. 27, 2023, dated May 17, 2023.

* cited by examiner

*Primary Examiner* — Janine M Kreck
(74) *Attorney, Agent, or Firm* — Larry R. Meenan

(57) ABSTRACT

A tool retainer is provided. The tool has a retainer sleeve having a longitudinal external tab to engage with an internal recessed radial groove with a tool holder, and wherein the retainer sleeve has one or more internal radial tabs that engage with a recessed groove in a rotating tool shank. A cutting tool assembly including a cutting bit and the retainer sleeve is provided.

2 Claims, 2 Drawing Sheets

TOOL RETAINER

CROSS-REFERENCE TO RELATED APPLICATION

Not applicable.

STATEMENT REGARDING FEDERALLY SPONSORED RESEARCH OR DEVELOPMENT

Not Applicable.

BACKGROUND OF THE INVENTION

1. Field of the Invention

The present invention relates to a cutting tool assembly employed in earth working, mining or construction applications, and more particularly relates to a tool having a retainer sleeve having a longitudinal external tab to engage with an internal recessed groove of a cylindrical bore of a cutting bit holder, and wherein the retainer sleeve has one or more internal radial tabs, and in certain embodiments four internal radial tabs, wherein each of these internal radial tabs has a convex portion that engages a recessed groove in a rotating tool shank.

2. Description of the Background Art

There is a need to prevent the tools from coming out of a holder during operation. This can happen from the tool coming out of the retainer (leaving the retainer in the holder) or the retainer coming out of the holder with the tool. If the force to install the tool with the retainer is too high then it becomes difficult to install the tools easily in the field. The current known retainers in use allow too much axial movement of the tool which allows the tools to come out of the holder causing the tool to bend or to break. The current known retainer designs contact the shank of the rotating tool at the top of the retainer causing the top of the retainer to wear thin. All of these problems of the known retainers can fail to prevent the tools from coming out of a holder during operation.

The background art discloses technology such as a rotary cone bit retained by a captive keeper ring, a pick-type mining tool that has a hard wear-resistant bushing in the holder, a pick-type mining bit with a cylindrical shank having a support block with a bore and a hard insert detachably and rotatably mounted in the bore. Further, the background art discloses a resilient retaining means for connecting work tools and work holders and ring-like members placed between a work tool and a work tool holder. Other background art discloses a keeper spring for connecting a mining tool to a work holder, or a retainer sleeve for a rotary bit including a longitudinally slit cylindrical portion and at least four circumferentially spaced tabs deformed radially inwardly from the longitudinal slit cylindrical portion. The background art also discloses a circular-shank tool comprising a shank held in a bore of a tool holder by a locking sleeve. The locking sleeve has one or more retaining elements that project inwards and engage in a peripheral groove in the shank of the tool.

This invention addresses the above disadvantages of the background art by incorporating a longitudinal tab to engage within a groove within a holder and four internal radial tabs each having a convex portion that engage a groove in a rotating tool shank.

SUMMARY OF THE INVENTION

A tool retainer is provided.

In one embodiment of this invention a retainer sleeve comprising a longitudinal external tab to engage with an internal recessed groove of a cylindrical bore of a cutting bit holder, and wherein the retainer sleeve has at least one or more internal radial tabs, and in certain embodiments four internal radial tabs, that engage a recessed groove in a rotating tool shank.

In another embodiment of this invention, a tool is provided having a retainer sleeve having a longitudinal external tab to engage with an internal recessed radial groove with a tool holder, and wherein the retainer sleeve has four internal radial tabs that engage with a recessed groove in a rotating tool shank.

Another embodiment of this invention provides a cutting tool assembly comprising a cutting bit having a cutting element and a cylindrical shank, a cutting bit holder having an internal cylindrical bore that has an internal recessed radial groove, an optional washer located between the cutting bit and the cutting bit holder, and a cylindrical retainer sleeve wherein the cylindrical retainer sleeve has a radially outward projecting longitudinal external tab located on an outer wall of the cylindrical retainer sleeve, one or more first internal radial tabs each having a convex portion, and wherein the cylindrical retainer sleeve fits inside the internal cylindrical bore of the cutting bit holder, and wherein the cylindrical shank fits inside the cylindrical retainer sleeve, and wherein the outward projecting longitudinal external tab of the cylindrical retainer sleeve fits into the internal recessed radial groove of the internal cylindrical bore of the cutting bit holder, and wherein the convex portion of each of the internal radial tabs, biases against and fits into a recess groove that is located on an outer wall of the cylindrical shank. In another embodiment of the cutting tool assembly of this invention, the outer wall of the cylindrical retainer sleeve has a split that forms an opening on the cylindrical retainer sleeve. The cylindrical retainer sleeve is made of a compressible material. In certain embodiments of this invention, the cutting tool assembly is provided wherein the retainer sleeve has a first internal radial tab having a first convex portion, a second internal radial tab having a second convex portion, a third internal radial tab having a third convex portion, and a fourth internal radial tab having a fourth convex portion, and wherein said first convex portion of said first internal radial tab, said second convex portion of said second internal radial tab, said third convex portion of said third internal radial tab, and said fourth convex portion of said fourth internal radial tab bias against and fit into a recess groove that is located on an outer wall of said cylindrical shank.

Another embodiment of a cutting tool assembly of this invention provides a cutting bit having a head, comprising a body located longitudinally below a cutting element and a shoulder located below the body, and a cylindrical shank that has an outer wall having a longitudinal length that extends in a longitudinal direction from below the shoulder, and a recess groove that is located on the outer wall of the cylindrical shank; a cutting bit holder having an internal cylindrical bore and a front face, and wherein the internal cylindrical bore has a mouth, and wherein the internal cylindrical bore has a longitudinal length the extends in a longitudinal direction of the cylindrical shank, and wherein the internal cylindrical bore has an internal recessed radial groove; a washer having a center hole, and wherein the washer is located between the shoulder of the cutting bit and the front face of the cutting bit holder; and a cylindrical retainer sleeve having an outer wall, said cylindrical retainer sleeve has a longitudinal length, and a split that is located on the circumference of the outer wall that forms an opening on the cylindrical retainer sleeve and wherein the split extends in a longitudinal direction along the longitudinal length of said cylindrical retainer sleeve, and wherein the cylindrical retainer sleeve having a radially outward projecting longitudinal external tab located on the outer wall, a first internal radial tab having a first convex portion, a second internal radial tab having a second convex portion, a third internal radial tab having a third convex portion, and a fourth internal radial tab having a fourth convex portion, and wherein the cylindrical retainer sleeve fits inside the internal cylindrical bore of the cutting bit holder, and wherein the cylindrical shank fits inside the cylindrical retainer sleeve, and wherein the outward projecting longitudinal external tab fits into the internal recessed radial groove of the internal cylindrical bore of the cutting bit holder, and wherein the first convex portion of the first internal radial tab, the second convex portion of the second internal radial tab, the third convex portion of the third internal radial tab, and the fourth convex portion of the fourth internal radial tab bias against and fit into the recess groove that is located on the outer wall of the cylindrical shank.

In another embodiment of this cutting tool assembly, the retainer sleeve has a first internal radial tab that is located in juxtaposition to and in communication with a second internal radial tab, wherein the second internal radial tab is located in juxtaposition to and in communication with a third internal radial tab, and wherein the third internal radial tab is located in juxtaposition to and in communication with a fourth internal radial tab.

The opening of the split of the cylindrical retainer sleeve is located opposite of the outward projecting longitudinal external tab of the cylindrical retainer sleeve, and wherein the opening of the split of the cylindrical retainer sleeve is located between the first internal radial tab and the fourth internal radial tab. The outward projecting longitudinal external tab of the cylindrical retainer sleeve fits into the internal recessed radial groove of the internal cylindrical bore of the cutting bit holder for preventing axial movement of the cylindrical retainer sleeve within the internal cylindrical bore of the cutting bit holder. The first convex portion of the first internal radial tab, the second convex portion of the second internal radial tab, the third convex portion of the third internal radial tab, and the fourth convex portion of the fourth internal radial tab bias against and fit into the recess groove that is located on the outer wall of the cylindrical shank for preventing axial movement of the cutting bit. The cylindrical shank has a circumference that is smaller than a circumference of the shoulder. The internal cylindrical bore of the cutting bit holder has a circumference that is larger than the circumference of the cylindrical shank. The washer has a center hole circumference that is larger than the circumference of the cylindrical shank and a center hole circumference that is smaller than the circumference of the shoulder. The outer wall of the cylindrical retainer sleeve has a circumference that is smaller than the circumference of the internal cylindrical bore of the cutting bit holder. The cylindrical retainer sleeve is made of a compressible material. The compressible material is, for example, but not limited to, one of a 1070 or 65 Mn spring steel. In certain embodiments, the opening of the split is about 8 millimeters in width in an uncompressed state (i.e. free state, see FIG. 5), and wherein the split is compressed to a width of from less than about 8 millimeters to greater than about 1 millimeter (i.e. compressed state, see FIG. 7).

These and other embodiments of this invention shall be described in more detail herein and in the drawings that show certain embodiments of this invention.

BRIEF DESCRIPTION OF THE DRAWINGS

While various embodiments of this invention are illustrated in the drawings, the particular embodiments shown should not be construed to limit the claims. Various modifications and changes may be made without departing from the scope of the invention.

DETAILED DESCRIPTION OF THE INVENTION

Figure 3:
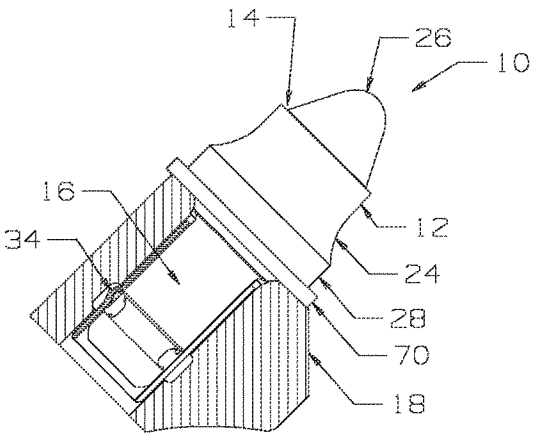
FIG. 3 shows a side cross sectional view of the retainer sleeve of this invention wherein the longitudinal external tab of the cylindrical retainer sleeve is engaged with the internal recessed radial groove of the cutting bit holder.
Figure 4:
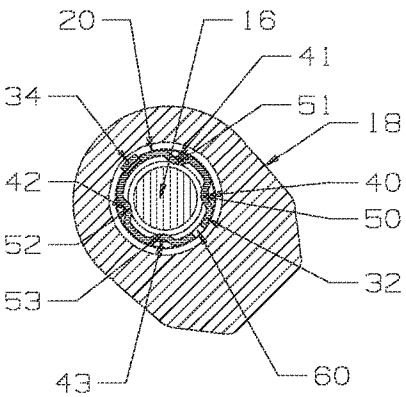
FIG. 4 shows a bottom cross sectional view of the retainer sleeve of this invention installed into the cutting bit holder.
Figure 1:
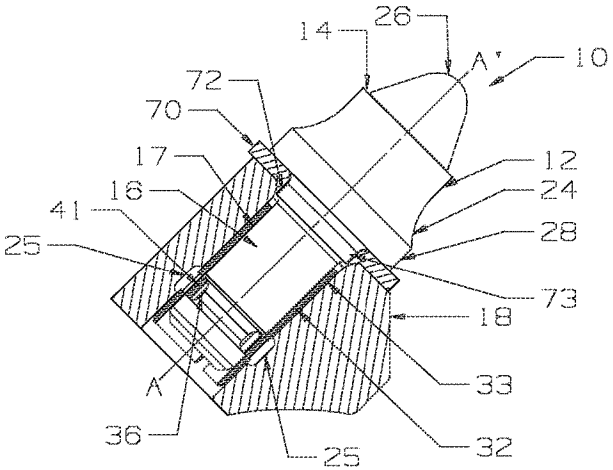
FIG. 1 shows a side cross sectional view of the retainer sleeve of this invention wherein the cylindrical shank of the cutting bit is within the cylindrical retainer sleeve.
Figure 2:
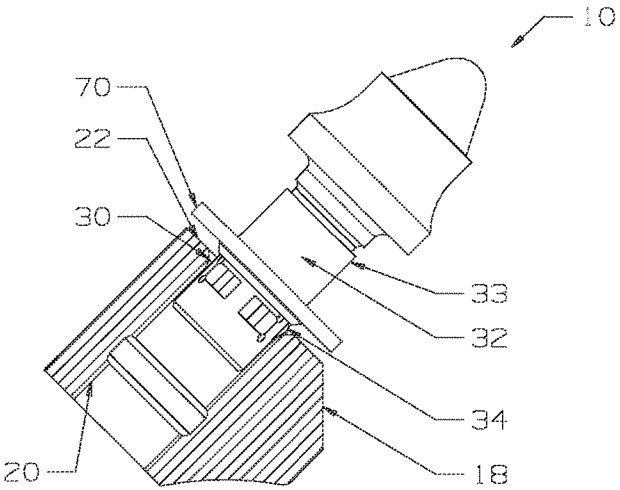
FIG. 2 shows a side view of the retainer sleeve of this invention wherein the longitudinal external tab of the cylindrical retainer sleeve is engaged with the mouth of the internal cylindrical bore of the cutting bit holder.

FIGS. 1-8 illustrate a retainer sleeve (32) comprising a longitudinal external tab (34) to engage with an internal recessed groove (25) of a cylindrical bore (20) of a cutting bit holder (18), and wherein the retainer sleeve (32) has one or more internal radial tabs, and in certain embodiments four internal radial tabs, namely a first internal radial tab (40) having a first convex portion (50), a second internal radial tab (41) having a second convex portion (51), a third internal radial tab (42) having a third convex portion (52), and a fourth internal radial tab (43) having a fourth convex portion (53) that engage a recessed groove (36) in a rotating tool shank (16) in accordance with an embodiment of the present invention.

There has been a need to design a retainer sleeve (32) with at least one longitudinal external tab (34) which allows one to install a tool into a cutting holder (18) with an internal recessed grove (25) of a cylindrical bore (20) of said cutting bit holder (18), and at the same time exerting spring pressure of an expanding retainer sleeve (32) onto the inner cylindrical bore (20) of the cutting bit holder (18). Additionally, the retainer sleeve (32) should hold onto the tool with at least one internal radial tab (40, 41, 42, or 43), respectively, having two parallel flat surfaces perpendicular to the tool axis. In certain embodiments of this invention, after assembling, the first convex portion (50) of the first internal radial tab (40), the second convex portion (51) of the second internal radial tab (41), the third convex portion (52) of the third internal radial tab (42), and the fourth convex portion (53) of the fourth internal radial tab (43) engage a recessed groove (36) on the shank (16) of the rotating tool, to prevent the tool from pulling out of the holder during operation.

The longitudinal external tab (34) is designed in a way to collapse the retainer sleeve (32) as it is installed to reduce the friction force between the retainer sleeve (32) and the bore (20) of a cutting bit holder (18). The longitudinal external tab (34) is also angled to lead into the bore (20) making it easier to install the tool as shown as angle $\alpha$ in FIG. 6. The angle $\alpha$ may range from 10°-40°, or between 20°-30°. The longitudinal external tab's (34) angled design also helps to make it easier to assemble the washer (70), an optional element, onto the retainer sleeve (32) above the longitudinal external tab (34) during manufacturing. There needs to be at least one longitudinal external tab (34) to engage the internal recessed radial groove (25) of the bore (20). The internal radial tabs (40, 41, 42, and 43) limit axial movement of the tool which helps to prevent the tool from coming out of the holder and bending/breaking. There needs to be at least one internal radial tab (40, 41, 42, or 43) to allow space for the longitudinal external tab (34) and a longitudinal split (60) which allows the retainer sleeve (32) to collapse (compress) during installation. The first, second, third, and fourth internal radial tabs (40, 41, 42, and 43), respectively, limit the axial movement of the tools such that a top of the retainer sleeve (32) does not contact a hub (73) at an upper portion of a shank (16) of a rotating tool. The first, second, third and fourth internal radial tabs (40, 41, 42, and 43), respectively, of the retainer sleeve (32) will come into contact with both sides of the recessed groove (36) of the shank (16) of the tool. During install, the top of the recessed groove (36) will contact the top of the first, second, third, and fourth internal radial tabs (40, 41, 42, and 43), respectively, and during removal, the bottom of the recessed groove (36) will contact the bottom of the first, second, third, and fourth internal radial tabs (40, 41, 42, and 43), respectively. The recessed groove (36) of the shank (16) will contact the first, second, third and fourth convex portions (50, 51, 52, and 53), respectively, of the first, second, third, and fourth internal radial tabs (40, 41, 42, and 43), respectively, of the retainer sleeve (32) before a top of the retainer sleeve (32) contacts the hub (73) at the upper portion of the shank (16).

Referring to FIGS. 1-8, in an embodiment of this invention, a tool (10) is provided comprising a retainer sleeve (32) having a longitudinal external tab (34) to engage with an internal recessed radial groove (25) with a tool holder (18), and wherein the retainer sleeve (32) has a first, a second, a third, and a fourth internal radial tabs (40, 41, 42, and 43), respectively, wherein that engage with a recessed groove (36) in a rotating tool shank (16).

Referring to FIGS. 1-8, in another embodiment of this invention, a cutting tool assembly (10) is provided comprising a cutting bit (12) having a cutting element (26) and a cylindrical shank (16), a cutting bit holder (18) having an internal cylindrical bore (20) that has an internal recessed radial groove (25), an optional washer (70) located between the cutting bit (12) and the cutting bit holder (18), and a cylindrical retainer sleeve (32) wherein the cylindrical retainer sleeve (32) has a radially outward projecting longitudinal external tab (34) located on an outer wall (33) of the cylindrical retainer sleeve (32), a first internal radial tab (40) having a first convex portion (50), a second internal radial tab (41) having a second convex portion (51), a third internal radial tab (42) having a third convex portion (52), and a fourth internal radial tab (43) having a fourth convex portion (53), and wherein the cylindrical retainer sleeve (32) fits inside the internal cylindrical bore (20) of the cutting bit holder (18), and wherein the cylindrical shank (16) fits inside the cylindrical retainer sleeve (32), and wherein the outward projecting longitudinal external tab (34) of the cylindrical retainer sleeve (32) fits into the internal recessed radial groove (25) of the internal cylindrical bore (20) of the cutting bit holder (18), and wherein the first convex portion (50) of the first internal radial tab (40), the second convex portion (51) of the and the second internal radial tab (41), the third convex portion (52) of the third internal radial tab (42), and the fourth convex portion (53) of the fourth internal radial tab (43), bias against and fit into a recess groove (36) that is located on an outer wall (17) of the cylindrical shank (16). In another embodiment of the cutting tool assembly (10) of this invention, the outer wall (33) of the cylindrical retainer sleeve (32) has a split (60) that forms an opening (61) on the cylindrical retainer sleeve (32). The cylindrical retainer sleeve (32) is made of a compressible material.

Referring to FIGS. 1-8, another embodiment of a cutting tool assembly (10) is provided comprising a cutting bit (12) having a head (14) comprising a body (24) located longitudinally below a cutting element (26), and a shoulder (28) located below the body (24), and a cylindrical shank (16) that has an outer wall (17) having a longitudinal length that extends in a longitudinal direction from below the shoulder (28), and a recess groove (36) that is located on the outer wall (17) of the cylindrical shank (16); a cutting bit holder (18) having an internal cylindrical bore (20) and a front face (22), and wherein the internal cylindrical bore (20) has a mouth (30), and wherein the internal cylindrical bore (20) has a longitudinal length the extends in a longitudinal direction of the cylindrical shank (16), and wherein the internal cylindrical bore (20) has an internal recessed radial groove (25); a washer, which is an optional element, (70) having a center hole (72), and wherein the washer is located between the shoulder (28) of the cutting bit (12) and the front face (22) of the cutting bit holder (18); and a cylindrical retainer sleeve (32) having an outer wall (33), the cylindrical retainer sleeve (32) has a longitudinal length, and a split (60) that is located on the circumference of the outer wall (33) that forms an opening (61) on the cylindrical retainer sleeve (32) and wherein the split (60) extends in a longitudinal direction along the longitudinal length of the cylindrical retainer sleeve (32), and wherein the retainer sleeve (32) having a radially outward projecting longitudinal external tab (34) located on the outer wall (33), a first internal radial tab (40) having a first convex portion (50), a second internal radial tabs (41) having a second convex portion (51), a third internal radial tab (42) having a third convex portion (52), and a fourth internal radial tab (43) having a fourth convex portion (53), and wherein the cylindrical retainer sleeve (32) fits inside the internal cylindrical bore (20) of the cutting bit holder (18), and wherein the cylindrical shank (16) fits inside the cylindrical retainer sleeve (32), and wherein the outward projecting longitudinal external tab (34) fits into the internal recessed radial groove (25) of the internal cylindrical bore (20) of the cutting bit holder (18), and wherein the first convex portion (50) of the first internal radial tab (40), the second convex portion (51) of the second internal radial tab (41), the third convex portion (52) of the third internal radial tab (42), and the fourth convex portion (53) of the fourth internal radial tab (43) bias against and fit into the recess groove (36) that is located on the outer wall (17) of the cylindrical shank (16). In another embodiment of this cutting tool assembly, the first internal radial tab (40) is located in juxtaposition to and is in communication with the second internal radial tab (41), and wherein the second internal radial tab (41) is located in juxtaposition to and in communication with the third internal radial tab (42), and wherein the third internal radial tab (42) is in juxtaposition to and in communication with the fourth internal radial tab (43). The opening (61) of the split (60) of the cylindrical retainer sleeve (32) is located opposite of the outward projecting longitudinal external tab (34) of the cylindrical retainer sleeve (32), and wherein the opening (61) of the split (60) of the cylindrical retainer sleeve (32) is located between the first internal radial tab (40) and the fourth internal radial tab (43). The outward projecting longitudinal external tab (34) of the cylindrical retainer sleeve (32) fits into the internal recessed radial groove (25) of the internal cylindrical bore (20) of the cutting bit holder (18) for preventing axial movement of the cylindrical retainer sleeve (32) within the internal cylindrical bore (20) of the cutting bit holder (18). The first convex portion (50) of the first internal radial tab (40), the second convex portion (51) of the second internal radial tab (41), the third convex portion (52) of the third internal radial tab (42), and the fourth convex portion (53) of the fourth internal radial tab (43), bias against and fit into the recess groove (36) that is located on the outer wall (17) of the cylindrical shank (16) for preventing axial movement of the cylindrical shank (16). The cylindrical shank (16) has a circumference that is smaller than a circumference of the shoulder (28). The internal cylindrical bore (20) of the cutting bit holder (18) has a circumference that is larger than the circumference of the cylindrical shank (16). The washer, which is an optional element, has a center hole (72) circumference that is larger than the circumference of the cylindrical shank (16) and a center hole (72) circumference that is smaller than the circumference of the shoulder (28). The outer wall (33) of the cylindrical retainer sleeve (32) has a circumference that is smaller than the circumference of the internal cylindrical bore (20) of the cutting bit holder (18). The cylindrical retainer sleeve (32) is made of a compressible material. The compressible material is, for example, but not limited to, one of a 1070 or 65 Mn spring steel. In certain embodiments, the opening (61) of the split (60) is about 8 millimeters in width in an uncompressed state (i.e. free state, FIG. 5), and wherein when the opening (61) of the split (60) is compressed, the compressed opening (61) has a width of from less than about 8 millimeters to greater than about 1 millimeter (i.e. compressed state, FIG. 7).

Referring to FIGS. 1-8, another embodiment of this invention provides a cylindrical retainer sleeve (32) comprising a cylindrical outer wall (33) that has a circumference and a longitudinal length, and a split (60) that is located on the circumference of the outer wall (33) that forms an opening (61) on the cylindrical retainer sleeve (32) and wherein the split (60) extends in a longitudinal direction along the longitudinal length of the cylindrical retainer sleeve (32), and wherein the cylindrical retainer sleeve (32) having a radially outward projecting longitudinal external tab (34) located on the outer wall (33), a first internal radial tab (40) having a first convex portion (50), a second internal radial tab (41) having a second convex portion (51), a third internal radial tab (42) having a third convex portion (52), and a fourth internal radial tab (43) having a fourth convex portion (53), and wherein the cylindrical retainer sleeve (32) fits inside an internal cylindrical bore (20) of a cutting bit holder (18), and wherein a cylindrical shank (16) fits inside the cylindrical retainer sleeve (32), and wherein the outward projecting longitudinal external tab (34) fits into an internal recessed radial groove (25) of the internal cylindrical bore (20) of the cutting bit holder (18), and wherein the first internal radial tab (40), the second internal radial tab (41), the third internal radial tab (42), and the fourth internal radial tab (43) bias against and fit into a recess groove (36) that is located on an outer wall (17) of the cylindrical shank (16). The cylindrical retainer sleeve (32) includes wherein the opening (61) of the split (60) of the cylindrical retainer sleeve (32) is located opposite of the outward projecting longitudinal external tab (34) of the cylindrical retainer sleeve (32), and wherein the opening (61) of the split (60) of the cylindrical retainer sleeve (32) is located between the first internal radial tab (40) and the fourth internal radial tab (43). The cylindrical retainer sleeve (32) is made of a compressible material. The compressible material is, for example but not limited to, one of a 1070 or a 65 Mn spring steel. In a particular embodiment of this invention, the opening (61) of the split (60) is about 8 millimeters in width in an uncompressed state (i.e. free state, FIG. 5), and wherein when the opening (61) of the split (60) is compressed, the compressed opening (61) has a width of from less than about 8 millimeters to greater than about 1 millimeter (i.e. compressed state, FIG. 7).

It will be appreciated by those persons skilled in the art that one or more internal radial tabs each having a convex portion that biases against and fits into the recess groove that is located on an outer wall of the cylindrical shank is provided in this invention. In certain embodiments, the retainer sleeve has a first internal radial tab having a first convex portion, a second internal radial tab having a second convex portion, a third internal radial tab having a third convex portion, and a fourth internal radial tab having a fourth convex portion, and wherein said first convex portion of said first internal radial tab, said second convex portion of said second internal radial tab, said third convex portion of said third internal radial tab, and said fourth convex portion of said fourth internal radial tab bias against and fit into a recess groove that is located on an outer wall of said cylindrical shank. It will be understood by those persons of skill in the art that the number of internal radial tabs provided will depend upon the diameter of the retainer ring, such that a large diameter retainer ring may require, for example, but not limited to, one or more internal radial tabs, or more than four internal radial tabs, in order to make the retainer ring stable.

Figure 8:
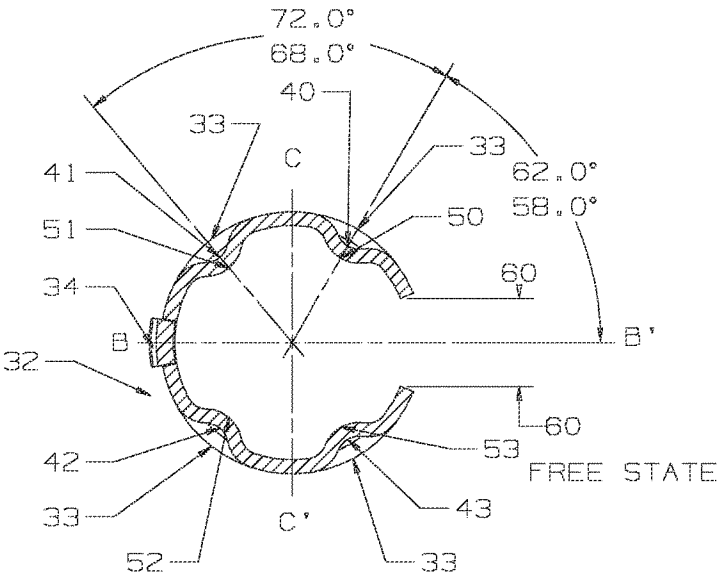
FIG. 8 shows a top cross sectional view of the cylindrical retainer sleeve in an uncompressed format (i.e. a free state) of this invention that describes the angles of an internal radial tab of the retainer sleeve.
Figure 7:
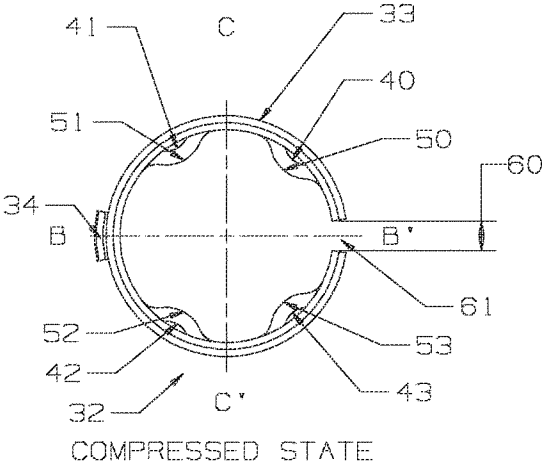
FIG. 7 show a top view of the cylindrical retainer sleeve in a compressed format (compressed state) of this invention.
Figure 5:
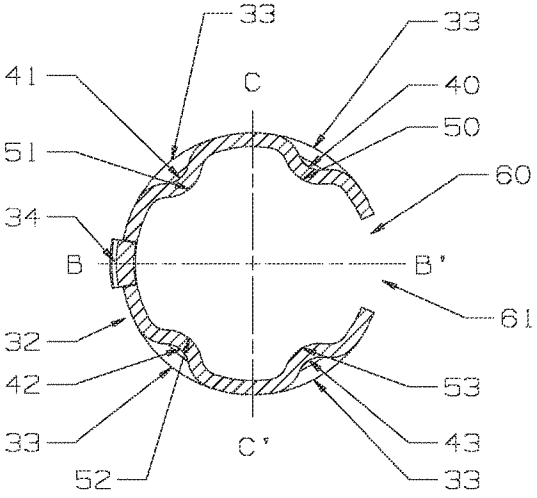
FIG. 5 shows a top cross sectional view of the cylindrical retainer sleeve in an uncompressed format (i.e. free state) of this invention.
Figure 6:
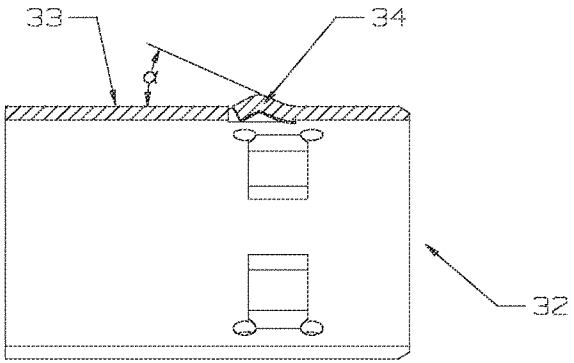
FIG. 6 shows a cross sectional view of the retainer sleeve showing the longitudinal external tab.

It will be appreciated by those persons skilled in the art that the cylindrical retainer sleeve of this invention is dimpleless. As used herein, the term "dimpleless" means the absence of protruding outwardly directed bulges or bumps. The cylindrical retainer sleeve of this invention is compressible such that in the compressed state at least one or more millimeters as a width of the opening of the split is maintained. FIG. 8 shows that the shows a top cross sectional view of the cylindrical retainer sleeve in an uncompressed format (i.e. a free state) of this invention wherein an embodiment of this invention shows that the first convex center portion of the first internal radial tab of the cylindrical retainer sleeve is positioned in relation to the horizontal axis of the cylindrical retainer sleeve B-B' is from about 58 degrees to about 62 degrees and the second internal radial tab of the cylindrical retaining sleeve is positioned in relation to the first internal radial tab of the cylindrical retaining sleeve from about 68 degrees to about 72 degrees.

As used herein, "including," "containing" and like terms are understood in the context of this application to be synonymous with "comprising" and are therefore open-ended and do not exclude the presence of additional undescribed or unrecited elements, materials, phases or method steps. As used herein, "consisting of" is understood in the context of this application to exclude the presence of any unspecified element, material, phase or method step. As used herein, "consisting essentially of" is understood in the context of this application to include the specified elements, materials, phases, or method steps, where applicable, and to also include any unspecified elements, materials, phases, or method steps that do not materially affect the basic or novel characteristics of the invention.

For purposes of the description above, it is to be understood that the invention may assume various alternative variations and step sequences except where expressly specified to the contrary. Moreover, all numbers expressing, for example, quantities of ingredients used in the specification and claims, are to be understood as being modified in all instances by the term "about". Accordingly, unless indicated to the contrary, the numerical parameters set forth are approximations that may vary depending upon the desired properties to be obtained by the present invention. At the very least, and not as an attempt to limit the application of the doctrine of equivalents, each numerical parameter should at least be construed in light of the number of reported significant digits and by applying ordinary rounding techniques.

It should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances. In this application, the articles "a," "an," and "the" include plural referents unless expressly and unequivocally limited to one referent.

Whereas particular embodiments of this invention have been described above for purposes of illustration, it will be evident to those skilled in the art that numerous variations of the details of the present invention may be made without departing from the invention as defined in the appended claims.

What is claimed is:

1. A cutting tool assembly comprising:

a cutting bit having a head comprising of a body located longitudinally below a cutting element and a shoulder located below said body, and a cylindrical shank that has an outer wall having a longitudinal length that extends in a longitudinal direction from below said shoulder, and a recess groove that is located on said outer wall of said cylindrical shank;

a cutting bit holder having an internal cylindrical bore and a front face, and wherein said internal cylindrical bore has a mouth, and wherein said internal cylindrical bore has a longitudinal length that extends in a longitudinal direction of said cylindrical shank, and wherein said internal cylindrical bore has an internal recessed radial groove;

a washer having a center hole, and wherein said washer is located between said shoulder of said cutting bit and said front face of said cutting bit holder; and a cylindrical retainer sleeve having an outer wall, said cylindrical retainer sleeve has a longitudinal length, and a split that is located on the circumference of said outer wall that forms an opening on said cylindrical retainer sleeve and wherein said split extends in a longitudinal direction along the longitudinal length of said cylindrical retainer sleeve, and wherein said retainer sleeve having a radially outward projecting longitudinal external tab located on said outer wall, a first internal radial tab having a first convex portion, a second internal radial tab having a second convex portion, a third internal radial tab having a third convex portion, and a fourth internal radial tab having a fourth convex portion, and wherein said cylindrical retainer sleeve fits inside said internal cylindrical bore of said cutting bit holder, and wherein said cylindrical shank fits inside said cylindrical retainer sleeve, and wherein said outward projecting longitudinal external tab fits into said internal recessed groove of said internal cylindrical bore of said cutting bit holder, and wherein said first convex portion of said first internal radial tab, said second convex portion of said second internal radial tab, said third convex portion of said third internal radial tab, and said fourth convex portion of said fourth internal radial tab bias against and fit into said recess groove that is located on said outer wall of said cylindrical shank, and wherein said opening of said split of said cylindrical retainer sleeve is located opposite of said outward projecting longitudinal external tab of said cylindrical retainer sleeve, and wherein said opening of said split of said cylindrical retainer sleeve is located between said first internal radial tab and said fourth internal radial tab.

2. A cylindrical retainer sleeve comprising:

a cylindrical outer wall that has a circumference and a longitudinal length, and a split that is located on the circumference of said outer wall that forms an opening on said cylindrical retainer sleeve and wherein said split extends in a longitudinal direction along the longitudinal length of said cylindrical retainer sleeve, and wherein said cylindrical retainer sleeve having a radially outward projecting longitudinal external tab located on said outer wall, one or more internal radial tabs each having a convex portion, and wherein said cylindrical retainer sleeve fits inside an internal cylindrical bore of a cutting bit holder, and wherein a cylindrical shank fits inside said cylindrical retainer sleeve, and wherein said outward projecting longitudinal external tab fits into an internal recessed radial groove of said internal cylindrical bore of said cutting bit holder, and wherein said convex portion of each of said internal radial tabs biases against and fits into a recess groove that is located on an outer wall of said cylindrical shank, wherein said retainer sleeve having a first internal radial tab having a first convex portion, a second internal radial tab having a second convex portion, a third internal radial tab having a third convex portion, and a fourth internal radial tab having a fourth convex portion, and wherein said first convex portion of said first internal radial tab, said second convex portion of said second internal radial tab, said third convex portion of said third internal radial tab, and said fourth convex portion of said fourth internal radial tab bias against and fit into a recess groove that is located on an outer wall of said cylindrical shank, and wherein said opening of said split of said cylindrical retainer sleeve is located opposite of said outward projecting longitudinal external tab of said cylindrical retainer sleeve, and wherein said opening of said split of said cylindrical retainer sleeve is located between said first internal radial tab and said fourth internal radial tab.

* * * * *